US007191612B2

(12) United States Patent
Chirnomas

(10) Patent No.: US 7,191,612 B2
(45) Date of Patent: Mar. 20, 2007

(54) THERMAL SEPARATING BAFFLE IN A VENDING MACHINE

(76) Inventor: Munroe Chirnomas, 47 Skyline Dr., Morris Township, NJ (US) 07960

( * ) Notice: Subject to any disclaimer, the term of this patent is extended or adjusted under 35 U.S.C. 154(b) by 137 days.

(21) Appl. No.: 10/505,811

(22) PCT Filed: Feb. 26, 2003

(86) PCT No.: PCT/US03/06059

§ 371 (c)(1),
(2), (4) Date: Aug. 26, 2004

(87) PCT Pub. No.: WO03/073018

PCT Pub. Date: Sep. 4, 2003

(65) Prior Publication Data

US 2005/0235681 A1 Oct. 27, 2005

Related U.S. Application Data

(60) Provisional application No. 60/360,130, filed on Feb. 26, 2002.

(51) Int. Cl.
*A47F 3/04* (2006.01)

(52) U.S. Cl. ..... 62/250; 62/378

(58) Field of Classification Search ..... 62/180, 62/190, 250, 331, 378; 221/150 R, 153, 221/145, 211; 312/404, 406, 407
See application file for complete search history.

(56) References Cited

U.S. PATENT DOCUMENTS 5,097,986 A * 3/1992 Domberg et al. ..... 221/150 R
5,240,139 A * 8/1993 Chirnomas ..... 221/2
5,873,489 A * 2/1999 Ide et al. ..... 221/279
5,901,877 A * 5/1999 Fujiu ..... 221/150 HC
5,971,205 A * 10/1999 Michaels et al. ..... 221/135
6,082,579 A * 7/2000 Chu ..... 221/150 R
6,253,955 B1 * 7/2001 Bower ..... 221/150 R
6,308,518 B1 * 10/2001 Hunter ..... 62/3.3
6,389,822 B1 * 5/2002 Schanin ..... 62/89
6,460,728 B2 * 10/2002 Kamimura ..... 221/150 HC
6,481,226 B2 * 11/2002 Jones et al. ..... 62/190
6,547,096 B1 * 4/2003 Chirnomas ..... 221/123

FOREIGN PATENT DOCUMENTS

JP 2001-357441 A * 12/2001

* cited by examiner

*Primary Examiner*—Mohammad M. Ali
(74) *Attorney, Agent, or Firm*—Lawrence C. Edelman, Esq.

(57) ABSTRACT

A vending machine apparatus (32) comprising a housing defining an internal cavity and an article storage area (76) positioned inside the cavity. The article storage area (76) has a cooling unit associated therewith for cooling the article storage area (76). A thermal barrier (12) is disposed within the housing and positioned between an outer perimeter of the article storage area (76) and the remainder of the internal cavity so as to substantially divide the internal cavity into first and second thermally separated sections (17*a–b*), with the cooling unit being located in the first section (17*a*). An opening in a portion of the housing is located in at least one of the first or second sections (17*a–b*), and a first air moving device is positioned in one of the first or second sections (17*a–b*) for causing an air flow path which removes heat developed by the cooling unit, from the first section inside the cavity.

20 Claims, 2 Drawing Sheets

THERMAL SEPARATING BAFFLE IN A VENDING MACHINE

CROSS-REFERENCE TO RELATED APPLICATIONS

This application claims priority under 35USC 120 of U.S. Provisional Patent Application No. 60/360,130 filed Feb. 26, 2002, entitled "Thermal Separating Baffle In A Vending Machine". The entire disclosure of this patent application is incorporated herein by reference in its entirety.

SUMMARY OF THE INVENTION

The present invention provides a thermal separating baffle in a refrigerated vending machine.

BRIEF DESCRIPTIONS OF THE DRAWINGS

The accompanying drawings, which are incorporated herein and constitute part of this specification, illustrate exemplary preferred embodiments and details of the invention, and together with the general description given above and the detailed description given below, serve to explain the features of the invention.

DETAILED DESCRIPTION OF THE PREFERRED EMBODIMENT

Figure 1:
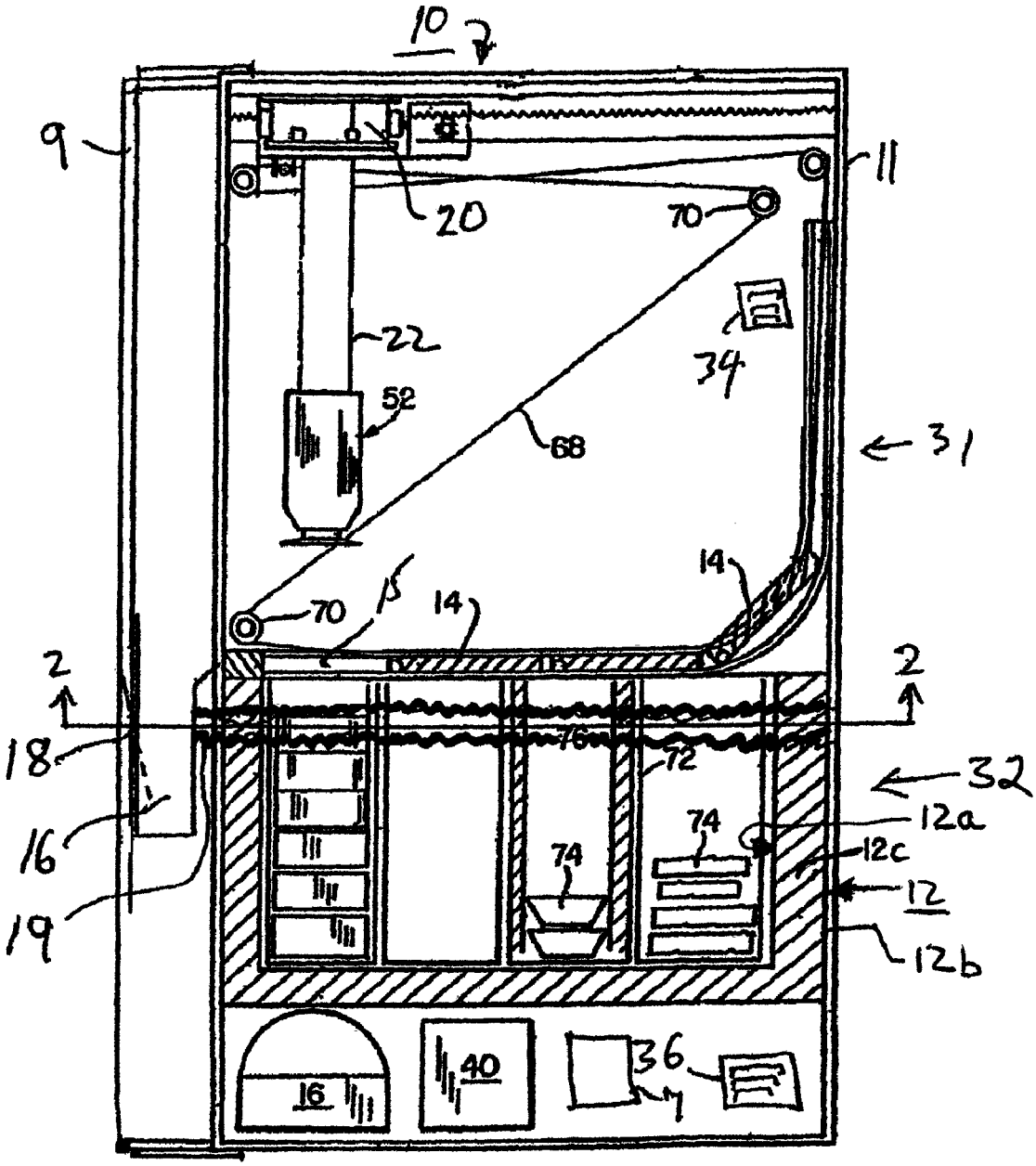
FIG. 1 is a side section view of an exemplary vending machine useful for illustrating one embodiment of a thermal barrier constructed and operating in accordance with the principles of the present invention.

FIG. 1 illustrates a prior art vending machine 10, such as known by prior U.S. Pat. No. 5,240,139, which is modified so as to illustrate one aspect of the present invention. Machine 10 has an outer housing 11 and hinged front door 9 for forming a cabinet for the vending machine. Housing 11 includes therein a refrigerated insulated compartment 12 for storing articles to be vended. In one embodiment, refrigerated compartment 12 has associated therewith a refrigeration unit 16 and a displaceable thermal separating door 14 positioned over an opening 15 in one side, in this case the topside, of compartment 12. Door 14 provides a thermal separation at the opening 15 between the remainder of the interior of the vending machine and the interior of compartment 12. The above-noted U.S. Pat. No. 5,240,139 shows and describes several different embodiments for door 14, including a single-piece hinged door which makes a vertical arcuate motion during opening/closing, as well as several "sliding" door designs. It is also noted that an "air curtain" can also form a thermal barrier that functions as a door, as well as merely having an air gap over compartment 12, which in some situations may be sufficient for effective operation of the vending machine, since cold air sinks, and therefore tends to stay within compartment 12 when left undisturbed. Compartment 12 includes therein open-topped subdivided sections 72 adapted for storing articles 74, such as ice cream or other frozen or refrigerated foods in a cooled environment until they are selected to be dispensed by a user of vending machine 10. A plurality of divider walls 76 are positioned inside compartment 12 so as to form the subdivided sections 72.

In operation, after a user of the vending machine has inserted the proper payment and made a valid selection of an item stored in the vending machine, a control mechanism 40 of machine 10, of conventional design, causes an article pickup carriage 20 having a suction hose 22 and pickup head 52 hanging therefrom, to be laterally positioned over the section 72 which stores at least one of the selected articles. In the illustrated embodiment, movement of carriage 20 causes door 14 to become displaced, via cable 68 and rollers 70, so as to provide entry and egress of article pickup head 52. The control mechanism 40 then causes a motor in carriage 20 to operate so that the article pickup head 52 controllably enters the selected compartment 72, suction generated by a blower motor 7 is conducted thereto via hose 22 (the full length of hose for connection to blower motor 7 is not shown in this Figure, but as one of ordinary skill in this art would realize, is required) and the selected article 74 thereby becomes secured to the article pickup head 52. The motor in carriage 20 is operated again, this time in a reverse direction, so as to extract article pickup head 52, and the selected article, from compartment 72, and deposit the selected article in a customer retrieval area 16. A customer access door 18 allows the user access to retrieve the dispensed article.

In view of the public availability of the above-noted patent, and the widely known construction and operation of vending machines of this type, no further description of how to make and use a vending machine of the type described so far, is considered necessary.

It is noted that in the illustrated embodiment, compartment 12 may comprise a "static" cooling system, such as a chest freezer, i.e., where, as well know to those of ordinary skill in the art, the refrigeration coils are located in the walls of compartment 12. More specifically, the evaporator coil portion 12*a* (not specifically shown in detail) of the refrigeration coils will be in good thermal contact with the interior of compartment 12, and the condenser coil portion 12*b* (not specifically shown in detail) of the refrigeration coils will be separated therefrom via thermal insulation 12*c*, and in good thermal contact with the outer walls of compartment 12. This known type of system results in the outer walls of compartment 12 radiating the heat generated by the system into volume 32, which, in accordance with the present invention is thermally separated from the volume in housing 11 having the opening into compartment 12, i.e., volume 31. Alternatively, compartment 12 could be cooled by a fan-based refrigeration system. Heat generated by compressor 16 or other portions of the refrigeration system could be more directly exhausted outside of housing 11 by appropriately positioned channeling to vent 36.

With such a device, during normal machine operation, the thermal barriers between the cooled and ambient areas inside of housing 11, in this case doors 14 and 18, are opened and closed many times, thereby repeatedly exposing warm air from housing 11 to the cooled air in compartment 12. Since cold air is heavier than warm air, when the door 14 is opened, the colder air tends to stay in the storage compartments 72, however, typically there is some unwanted mixing of the ambient air with the refrigerated air at the top of the storage compartments 72, at least partially due to air currents caused movements of the picker head, the opening and closing of door 14 and other parts of machine 10, thereby introducing unwanted heat into the freezer. At least some of this unwanted hot air was generated by the compressor and condenser as described above.

It is one object of the present invention reduce this unwanted mixing of hot air in compartment 12.

Accordingly, in accordance with one aspect of the present invention, a thermal insulator or baffle 19 is provided about the periphery of the compartment 12 so as to effectively form first and second thermally separate volumes 31 and 32 within housing 11. It is noted that it is not necessary for the thermal separation provided by baffle 19 of the invention to be "leak-proof" for substantial benefits in thermal efficiency to be achieved.

Figure 2:
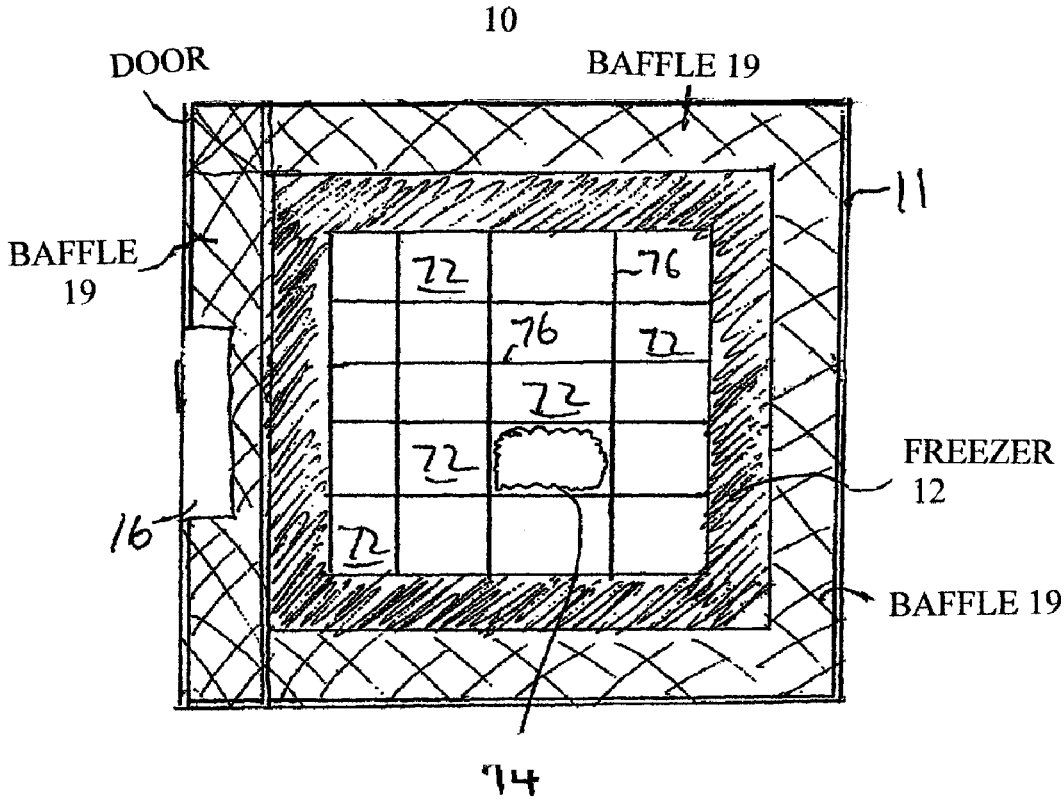
FIG. 2 is a simplified top section view along lines 2—2 of FIG. 1.

Referring simultaneously to FIGS. 1 and 2, illustrating a preferred embodiment of this aspect of the invention, these volumes are shown vertically oriented. More specifically, volume 32 is located in the lower portion of housing 11 and thermally separates some of the heat generating components, such as refrigeration unit 16 and the suction generating blower motor 7, from the remainder of the interior of housing 11, which is located above volume 32. Volume 31 is located in the upper portion of housing 11 and above volume 32, and includes therein opening 15 and door 14, which provide access into the cooled article storage areas 72.

In accordance with a further aspect of the present invention, separate ventilation is provided for each of volumes 31 and 32, comprising, for example, passive vents 34 and 36, respectively, which allow air flow from inside housing 11 to outside housing 11, or passive vents having powered fans (not specifically shown, but which are aligned with vents 34 and 36) to improve the exhaust airflow. Of course, suitable "inlet" airflow would be required if sufficient openings are not already provided, for example by the opening into the customer retrieval area 16 or near the bottom of front door 9.

Baffle 19 can be attached to the inside walls of housing 11 or the outside walls of the compartment 12, or a combination of both, in order to effectively make the separate thermal volumes 31 and 32.

It is noted that for that portion of compartment 12 facing the front door 9, the baffle can be attached to portions of the door 9 rather than the inside walls of housing 11. It is also noted that appropriate flexibility and/or openings and/or flaps may be needed as part of baffle 19 to form an effective thermal seal around various other parts of vending machine, such as customer retrieval area 16 or an alternative type of opener for door 14.

In accordance with a further aspect of the present invention, the air flow generated by a fan that is used to conduct heat away from the suction generating blower motor 7, and/or compressor 16, is directed to the thermal volume 32, where it can be conducted to the exterior of housing 11 either passively or by the use of a fan, via vent 36. Alternatively, as noted above, vent 34 could also be used if suitable ventilation ducting is provided so the exhausted heat does not adversely affect volume 31 as it passes therethrough.

It is noted that the cooled air which enters pickup head 52 during the dispensing operation may be directed into the thermal volume 31 or 32, where it can be conducted to the exterior of housing 11 either passively or using fans, via vents 34 or 36. Alternatively, since the "suction-air" substantially comprises cooled air taken from freezer 12, thermal efficiency may benefit if this air remain inside volume 31.

In accordance with an even further aspect of the present invention, compartment 12 can be mechanically mounted and electrically connected within housing 11 so as to be at least partially removable therefrom, such as by the use of sliding tracks mounted between a bottom portion of compartment 12 and housing 11, so as to assist in repositioning of compartment 12 to be at least partially outside of housing 11 during re-loading of compartment 12 with fresh articles to be vended. If necessary, any electrical connection to compartment 12 required for operating the cooling equipment associated therewith, could be selectively disconnectable, so as to facilitate the repositioning of compartment 12.

While the present invention has been disclosed with reference to certain embodiments, numerous modifications, alterations and changes to the described embodiments are possible without departing from the sphere and scope of the present invention, as defined above, and claims which follow at the end of this description.

For example, it is noted that the invention described herein is not limited to any specific type of article retrieving device (such as the illustrated pickup head 52). For example, it may be desirable for the robotic positioning mechanism to include a rotary device (R, θ) of the type including an I beam of fixed length (or telescopic sections), for establishing an "R" movement for pickup head 52, and where pivoting of the I beam establishes a "θ" movement. Alternatively, in other environments for the invention, the pickup head positioning mechanism may include an articulated arm or scissor system, or use a totally different dispensing technique, such a the more conventional spiral wire dispenser mechanism. Other types of suitable pickup devices include a mechanical claw or scoop, a magnetic attracting device, a portable suction generator, etc.

Additionally, it is noted that the principles of the present invention described herein may be advantageously combined with other ones of my inventions, such as the invention described in U.S. Ser. No. 60/360,128 entitled THERMAL BARRIER FOR A REFRIGERATED COMPARTMENT IN A VENDING MACHINE, incorporated in full herein by reference. This invention provides an additional thermal barrier at the open-topped article discharge opening of each compartment 72 (called a bin 22 in this other description), the purpose of which is to also reduce the problem of heat entering the storage compartments 72 when the door 14 is open. This additional thermal barrier is able to be selectively penetrated or opened in alignment with the top of each of compartments 72 during the dispensing operation, so as to not prevent the passage of stored articles out the top of the compartments 72, but at other times provides an additional thermal barrier over the tops of compartments 72.

Figure 3:
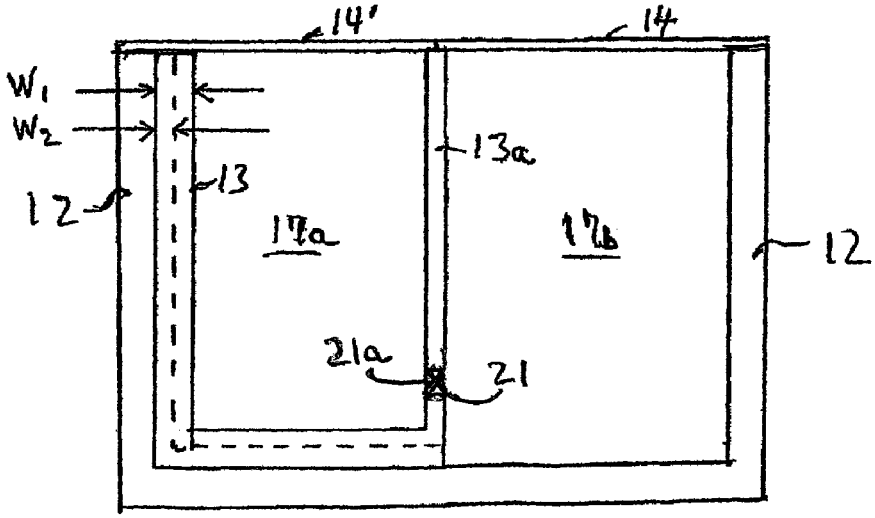
FIG. 3 is a simplified cross-section side view of a storage cabinet of the type usable in a vending machine of the type illustrated in FIG. 1, useful for illustrating a further aspect of the invention relating to the use of thermal barriers in a vending machine.

FIG. 3 illustrates a further aspect of invention relating to use of thermal baffles in vending machines. More specifically, in accordance with this aspect of the invention, in order to provide a simple, low cost and reliable vending machine which has storage capabilities for both frozen articles (such as ice cream or meals), as well as articles that are merely cooled to temperatures above freezing (such as chocolate confections or fresh foods), compartment 12 includes an additional thermal barrier arrangement, e.g., walls 13, arranged therein for creating a "less cooled" environment 17*a*, and an environment 17*b* which is cooled to a greater extent than environment 17*a*. Environment 17*b* comprises the remainder of the interior of compartment 12. In the embodiment where compartment 12 comprises a static freezer, walls 13 are provided in direct contact with the walls forming 3 sides (and possibly the bottom as well) of compartment 12, and a wall 13*a* is provided so as to divide the interior of compartment 12 into environments 17*a* and 17*b*.

It is also noted that the present invention is particularly advantageous when compartment 12 is of the type which has the evaporator coils distributed along and in thermal contact with the inside walls which form the main interior volume of compartment 12, and the condenser coils are thermally insulated from the evaporator coils and distributed along and in thermal contact with the walls which form the outside perimeter of compartment 12. With this type of freezer, no fans are required for the refrigeration system since the cooling effect of the evaporator coils is directly radiated to the interior of compartment 12, and the heat generated by the refrigeration system is directly radiated by the outside walls of compartment 12 to the external environment. Such chest freezers are commonly available form many sources.

Note, in an alternative embodiment of the invention, contact by walls 13 to the interior walls of compartment 12 does not have to be direct, and in fact can be with as few as one of the walls used to form environment 17*a*.

Control of the size of environment 17*a* is easily adjusted by adjusting the placement of wall 13*a*, which can be facilitated by, for example, a series of preformed slots in the floor and/or interior walls of compartment 12, which slots can be engaged by tabs (not shown) about the periphery of wall 13*a*. Alternatively, the insulated walls 13 used for forming compartments 17*a* and 17*b*, may comprise a pre-assembled box or tub having an open top, which can be simply placed/dropped inside compartment 12, thereby dividing compartment 12 into the two thermally separate environments.

Control of the temperature inside environment 17*a* can be adjusted by appropriate sizing of the thickness of walls 13, and to some extent, also wall 13*a*. For example, a wall 13 having a thickness $W_1$ in contact with a cooled interior wall of compartment 12 would have twice the insulation characteristics of one having a thickness $W_2$, and therefore the thickness of walls 13 can to a great extent relatively simply determine the amount of cooling provided to environment 17*a* as compared with that provided to environment 17*b*.

Additional control of the temperature inside environment 17*a* can be provided by a vent 21 formed in a wall that is common with the frozen environment, i.e. in wall 13*a*, to allow flow of cooled air from environment 17*b* into environment 17*a*. Additionally, vent 21 could include a baffle for selectively varying the size or flow rate of the opening in wall 13*a*. *Additionally, a powered device, such as a fan* 21*a* could alter the flow rate between these environments. In this case, the baffle or fan could be controlled by a temperature sensing device mounted in environment 17*a* or 17*b*, such as an electrical or mechanical thermostat. Furthermore, the vent 21 could be located at a height in wall 13*a* which is different than that show in FIG. 3, such as near the top. Even furthermore, vent 21, or an additional vent, not shown, could be located in a wall of compartment 12 so as to provide a flow of ambient air from outside of compartment 12 into environment 17*a* or 17*b* in order to warm the respective environment.

As shown in FIG. 3, door 14 of FIG. 1 could still be used over environment 17*b*, and a separately operating door 14' could be used over environment 17*a*, to further enhance thermal efficiency. Alternatively, a commonly operating door 14 could be used without departing from the scope of the invention.

Even furthermore, it is noted that the "dual-temperature" cooled environment invention described herein finds advantageous use in combination with the perimeter thermal baffle invention noted above, as well as in combination with the above-noted invention described in U.S. Ser. No. 60/360, 128 entitled entitled THERMAL BARRIER FOR A REFRIGERATED COMPARTMENT IN A VENDING MACHINE. Note, the principles of this aspect of the invention are equally applicable to making more than two, i.e., three or even more, thermally separated sections in article storage compartment 12.

Accordingly, it is intended that the present invention not be limited to the described embodiments, but that it has the full scope defined by the above language and following claims, as well as equivalents thereof.

The invention claimed is:

1. A vending machine apparatus comprising, a housing defining an internal cavity, an article storage area positioned inside the cavity, the article storage area having an article passage opening therein for allowing removal of articles stored therein, and a cooling unit associated therewith for cooling the article storage area, yet also generating unwanted heat;

a thermal barrier disposed within the housing and positioned between an outer perimeter of the article storage area and the remainder of the internal cavity so as to substantially divide the internal cavity into first and second thermally separated sections, with the cooling unit being located in the first section and the article passage opening being located in the second section.

2. The apparatus of claim 1, including a further opening in a portion of the housing which is located in at least one of the first or second sections; and a first air moving device positioned in one of the first or second sections for causing an air flow path for removing heat which was developed by the cooling unit, from the first section inside the cavity.

3. The apparatus of claim 2, wherein the further opening is located in the first thermally separated section.

4. The apparatus of any of the prior claims, wherein the first air moving device is located in the first thermally separated section.

5. The apparatus of any of the prior claims, further including an opening in a portion of the housing which is in the second section; and a second air moving device positioned in the second section for causing an air flow path which removes heat from inside the second section of the cavity.

6. The apparatus of any of the prior claims, wherein the article storage area is mechanically mounted in a selectively repositionable manner to a lower portion of the internal cavity, so that said article storage area is adapted to be repositionable in a manner to facilitate reloading of the area with articles to be stored therein.

7. The apparatus of any of the prior claims, wherein the article storage area and associated cooling unit comprise a self-contained freezer unit.

8. The apparatus of claim 7, wherein the self-contained freezer unit is electrically connected in a selectively disconnectable manner to an electrical portion of the vending machine.

9. The apparatus of any of the prior claims, wherein the thermal baffler comprises a baffle substantially spanning the entire space between the outside perimeter of the article storage area and the inside walls of the housing, so as to divide the space inside the housing into the first and second sections.

10. The apparatus of any of the prior claims, wherein the housing includes a door hingedly mounted on an open side thereof, and at least a portion of the thermal barrier is positioned between the outside perimeter of the article storage area and a portion of the door facing the internal cavity.

11. A vending machine apparatus comprising, a housing defining an internal cavity, an article storage compartment positioned inside the cavity, the article storage compartment having an article passage opening in one side of the article storage compartment for allowing removal of articles stored inside the compartment, and a cooling unit having a cold generating portion in thermal contact with one or more inside walls of the article storage compartment for cooling the inside of the article storage compartment, and a heat generating portion in thermal contact with one or more outside walls of the article storage compartment for radiating heat to the outside of the article storage compartment; and a thermal barrier disposed within the housing and positioned between an outside walls of the article storage compartment and the remainder of the internal cavity so as to substantially divide the internal cavity into first and second thermally separated sections, wherein a substantial portion of outside walls of the article storage compartment which are in thermal contact with the heat generating portion of the cooling unit are located in the first thermally separated section, and the article passage opening of the article storage compartment is located in the second thermally separated section.

12. The apparatus of claim 11, including a further opening in a portion of the housing which is located in at least one of the first or second sections; and a first air moving device positioned in one of the first or second sections for causing an air flow path for removing heat which was developed by the heat generating portion of the cooling unit, from the first section inside the cavity.

13. The apparatus of claim 12, wherein the further opening is located in the first thermally separated section.

14. The apparatus of any of claims 11–13, wherein the first air moving device is located in the first thermally separated section.

15. The apparatus of any of claims 11–13, further including:

an opening in a portion of the housing which is in the second section; and a second air moving device positioned in the second section for causing an air flow path which removes heat from inside the second section of the cavity.

16. The apparatus of any of claims 11–13, wherein the article storage area is mechanically mounted in a selectively repositionable manner to a lower portion of the internal cavity, so that said article storage area is adapted to be repositionable in a manner to facilitate reloading of the area with articles to be stored therein.

17. The apparatus of any of claims 11–13, wherein the article storage area and associated cooling unit comprise a self-contained freezer unit having a static cooling system.

18. The apparatus of claim 17, wherein the self-contained freezer unit is electrically connected in a selectively disconnectable manner to an electrical portion of the vending machine.

19. The apparatus of any of claims 11–13, wherein the thermal baffler comprises a baffle substantially spanning the entire space between the outside perimeter of the article storage area and the inside walls of the housing, so as to divide the space inside the housing into the first and second sections.

20. The apparatus of any of claims 11–13, wherein the housing includes a door hingedly mounted on an open side thereof, and at least a portion of the thermal barrier is positioned between the outside perimeter of the article storage area and a portion of the door facing the internal cavity.

* * * * *